US006236153B1

(12) United States Patent
Kim

(10) Patent No.: US 6,236,153 B1
(45) Date of Patent: May 22, 2001

(54) ELECTRODE FOR ELECTRON GUNS OF A COLOR CATHODE RAY TUBE

(75) Inventor: Jeong-nam Kim, Gunpo (KR)

(73) Assignee: Samsung Display Devices Co., Ltd., Kyungki-do (KR)

( * ) Notice: Subject to any disclaimer, the term of this patent is extended or adjusted under 35 U.S.C. 154(b) by 0 days.

(21) Appl. No.: 09/339,935

(22) Filed: Jun. 25, 1999

(30) Foreign Application Priority Data

Dec. 2, 1998 (KR) ..... 98-52519

(51) Int. Cl.[7] ..... H01J 29/50

(52) U.S. Cl. ..... 313/414; 313/412; 313/425; 313/432; 313/439

(58) Field of Search ..... 313/412, 414, 313/425, 426, 432, 434, 439, 458

(56) References Cited

U.S. PATENT DOCUMENTS 5,414,323 * 5/1995 Uchida et al. ..... 313/458 X
5,894,191 * 4/1999 Kim ..... 313/414 X
5,917,275 * 6/1999 Uchida et al. ..... 313/412 X
5,994,851 * 11/1999 Kim ..... 313/414 X

* cited by examiner

*Primary Examiner*—Ashok Patel
(74) *Attorney, Agent, or Firm*—Leydig, Volt, & Mayer, Ltd.

(57) ABSTRACT

An electrode for electron guns of a color cathode ray tube includes an external rim electrode having a large electron beam-passing hole through which three electron beams pass; and first and second internal electrode pieces mounted in the large electron beam-passing hole, separated from each other and forming a central small electron beam-passing hole and two side small electron beam-passing holes wherein the central small electron beam-passing hole is defined by inner edges of the first and second internal electrode pieces, between the first and second internal electrode pieces, and the inner edges have the curvature of part of an ellipse having a major axis larger than the width of the large electron beam-passing hole.

8 Claims, 6 Drawing Sheets

ELECTRODE FOR ELECTRON GUNS OF A COLOR CATHODE RAY TUBE

BACKGROUND OF THE INVENTION

1. Field of the Invention

The present invention relates to electron guns for a color cathode ray tube, and more particularly, to an electrode of electron guns for a color cathode ray tube which constitutes a large diameter electron lens.

2. Description of the Related Art

In general, in electron guns, since spherical aberration and focusing characteristics are largely affected by a main lens, the diameter of the main lens must be as large as possible in order to attain excellent focusing characteristics.

However, in in-line electron guns, since three electron beam-passing holes are formed, in a line, in at least two electrodes forming electron lenses, and the diameter of the neck portion of a funnel in which the electron guns are installed is restricted by the design requirements of deflection and convergence yokes, etc., it is not possible to make the diameter of the electron beam-passing holes larger than the distance between the centers of the two electron beam-passing holes.

A structure of electron guns for improving spherical aberration in a conventional main lens is disclosed in U.S. Pat. No. 4,370,592, and is shown in FIG. 1. As shown in FIG. 1, burring portions 5*b* and 6*b* are formed at the inner peripheries of the exit plane 5*a* of a focusing electrode 5 and the entrance plane 6*a* of a final accelerating electrode 6, respectively, and large diameter electron beam-passing holes (hereinafter referred to as large apertures) 5H and 6H having a predetermined depth are formed in the central portions of the planes. Also, small diameter electron beam-passing holes (hereinafter referred to as small apertures) 5H' and 6H' through which R, G and B electron beams independently pass, respectively, are formed in the large apertures 5H and 6H.

When the electron beams pass through the main lens formed by the focusing electrode 5 and the last accelerating electrode 6, since the large apertures 5H and 6H are non-circular or oblong and therefore vertical and horizontal convergent components of an electron beam having passed through the central small aperture and electron beams having passed through two side small apertures are different from each other, electron beam spots on a phosphor surface one not uniform. That is, as shown in FIG. 2, two side beams RB and BB passing through the large aperture 5H or 6H of the focusing electrode 5 or the last accelerating electrode 6 are horizontally close to the burring portions 5*b* and 6*b* where a low or high voltage is distributed, and the central electron beam GB is relatively far from the burring portions 5*b* and 6*b*. Accordingly, the two side electron beams are converged to a relatively larger extent, and the central beam is converged to a smaller extent.

In addition, since the distances between the two side beams RB and BB and the burring portions 5*b* and 6*b* are different from each other depending on direction, the horizontal and vertical converging forces acting on the electron beams are different from each other. In addition, since the vertical distances between the central beam GB and the burring portions 5*b* and 6*b* are shorter than the horizontal distances between them, the central beam GB is subject to stronger vertical converging forces. Further, the central beam GB suffers diverging forces in diagonal directions of the large apertures 5H and 6H. Therefore, since the sections of the two side beams RB and BB having passed the main lens are generally triangular, and the section of the central beam GB has a radial shape, uniform sections of electron beams cannot be obtained.

In particular, since the diameter of the small apertures 5H' and 6H' is restricted by the diameter of the neck portion of a cathode ray tube, there is a limit in increasing the distance between the centers of the small apertures 5H' or 6H'. Further, since the diameter of the neck portion tends to be reduced to reduce deflection yoke power consumption, the separation between the small apertures 5H' or 6H' become smaller and there are problems in which the spherical aberration increases and focusing characteristics are deteriorate.

A electrode structure for solving the above problems is disclosed in U.S. Pat. No. 5,414,323. As shown in FIG. 3, in the electrode structure, an electrode plate 16 is installed at the center of an external electrode 11 in which a large aperture is formed, a small aperture 13 of a longitudinally elongated shape is formed at the center of the electrode plate 16, and the sides of the electrode plate are cut to have semi-elliptical shapes in order to form two side electron beam-passing holes 14 and 15.

By making the central small aperture longitudinally elongated, the astigmatism caused by the large aperture is offset. However, in the above electrode, eight-pole astigmatism of the central electron beam-passing hole and six-pole astigmatism of the two side electron beam-passing holes are not corrected easily.

Another example of a conventional large diameter electrode is disclosed in U.S. Pat. No. 4,626,738. As shown in FIG. 4, the electrode includes an external electrode 21 in which a large aperture is formed, and an internal electrode 22 which is installed in the external electrode 21 and in which polygonal small apertures 22R, 22G and 22B are formed. Here, the astigmatisms caused by the large aperture can be compensated for by the polygonal small apertures 22R, 22G and 22B, but the polygonal small apertures 22R, 22G and 22B are not easily manufactured.

SUMMARY OF THE INVENTION

To solve the above problems, it is an objective of the present invention to provide an electrode to electron guns for a color cathode ray tube in which the astigmatisms caused by the large diameter electron beam-passing hole are easily corrected enhancing the focusing characteristics.

Accordingly, to achieve the above objective, there is provided an electrode of electron guns for a color cathode ray tube including: an external rim electrode in which a large diameter electron beam-passing hole through which all three electron beams pass is formed; and first and second internal electrode pieces installed in the large diameter electron beam-passing hole to be separated from each other with a predetermined gap and forming a central small diameter electron beam-passing hole and two side small diameter electron beam-passing holes which are arranged in a line within the large diameter electron beam-passing hole, wherein the central small diameter electron beam-passing hole is formed by inner edges of the first and second internal electrode pieces between the first and second internal electrode pieces, and the inner edges have the curvature of the minor axis of an ellipse having a major axis larger than short width of the large diameter electron beam-passing hole.

In addition, the electrode further includes a flange inwardly extending from the end of the external rim electrode and defining the large diameter electron beam-passing hole.

Curved edges having the radii of curvature of the major axis of an ellipse disposed in a direction of the major axis of the large diameter electron beam-passing hole are formed at inner sides of the flange.

According to one aspect of the present invention, there is provided an electrode of electron guns for a color cathode ray tube wherein edges other than the inner edges of the first and second internal electrode pieces contact the inner surface of the external rim electrode, and the two side small diameter electron beam-passing holes are formed in the first and second internal electrode pieces, respectively.

Here, the side small diameter electron beam-passing holes are preferably circular or non-circular.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
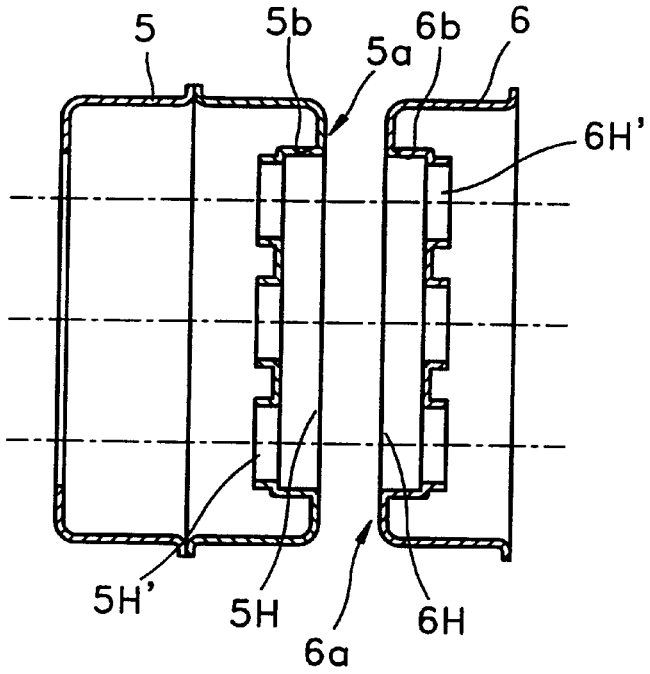
FIG.1(PRIOR ART)
FIG. 1 is a section view illustrating conventional electrodes of electron guns of a cathode ray tube.
Figure 2:
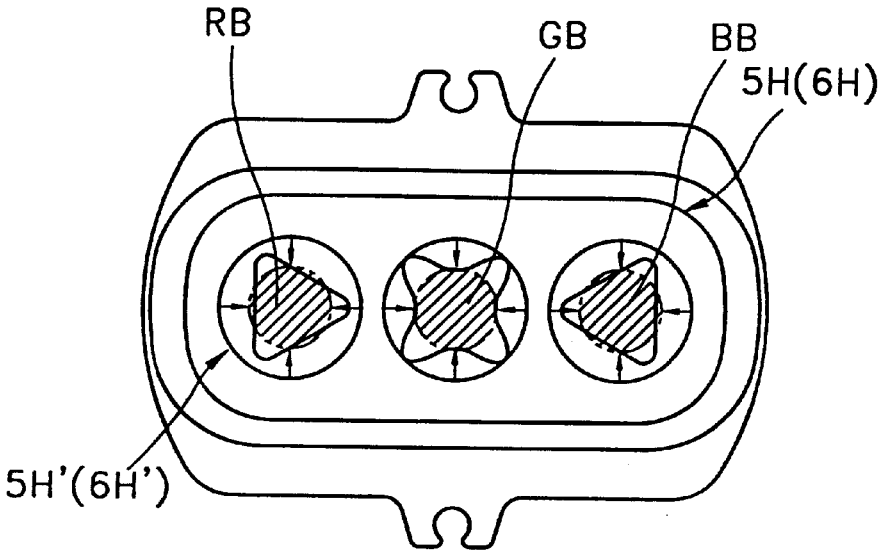
FIG.2(PRIOR ART)
FIG. 2 is a front view illustrating the electrodes shown in FIG. 1.
Figure 3:
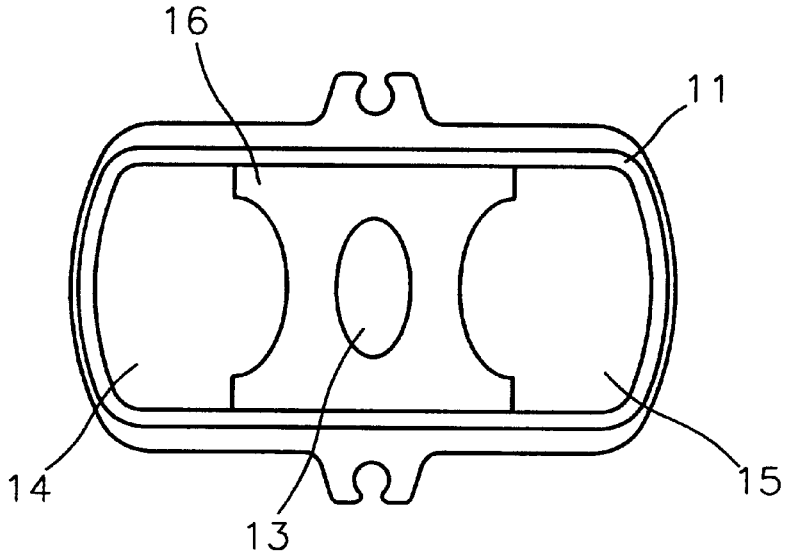
FIG.3(PRIOR ART)
FIGS. 3 and 4 are front views illustrating other examples of conventional electrodes of electron guns.
Figure 4:
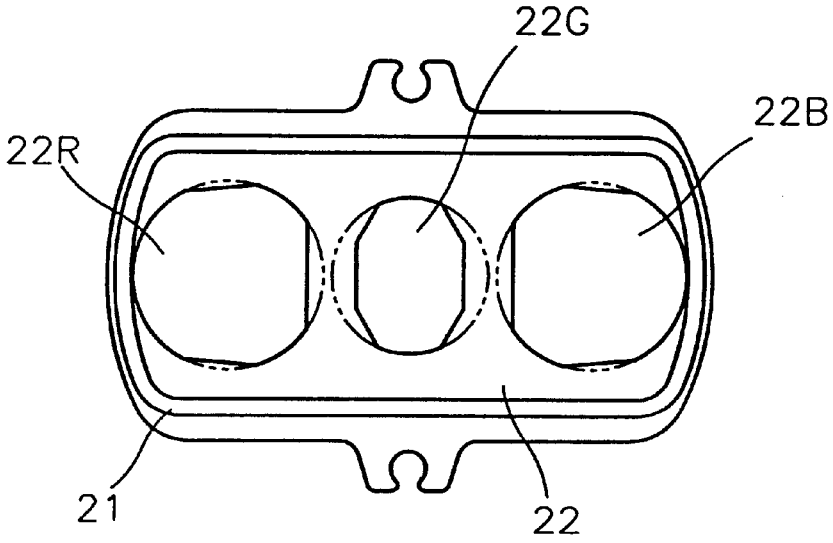
FIG.4(PRIOR ART)
Figure 5:
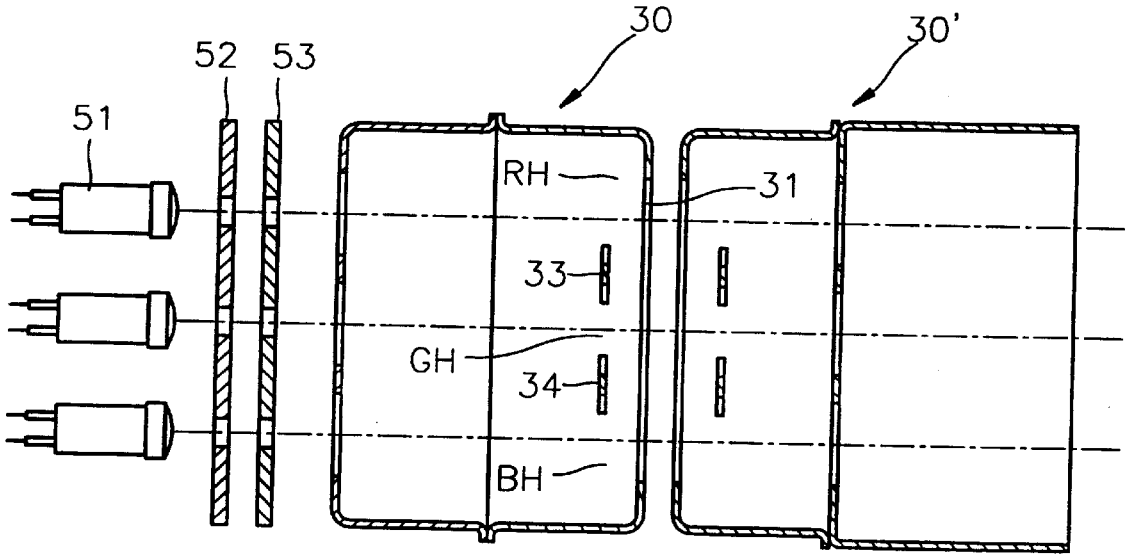
FIG. 5 is a section view illustrating electron guns employing electrodes according to one embodiment of the present invention.

FIG. 5 shows electron guns for a color cathode ray tube employing electrodes according to one embodiment of the present invention. As shown in FIG. 5, the electron guns include cathodes 51, a control electrode 52 and a screen electrode 53 which constitute triodes, and a bipotential main lens is formed with a converging electrode 30 and a final accelerating electrode 30'.

Figure 6:
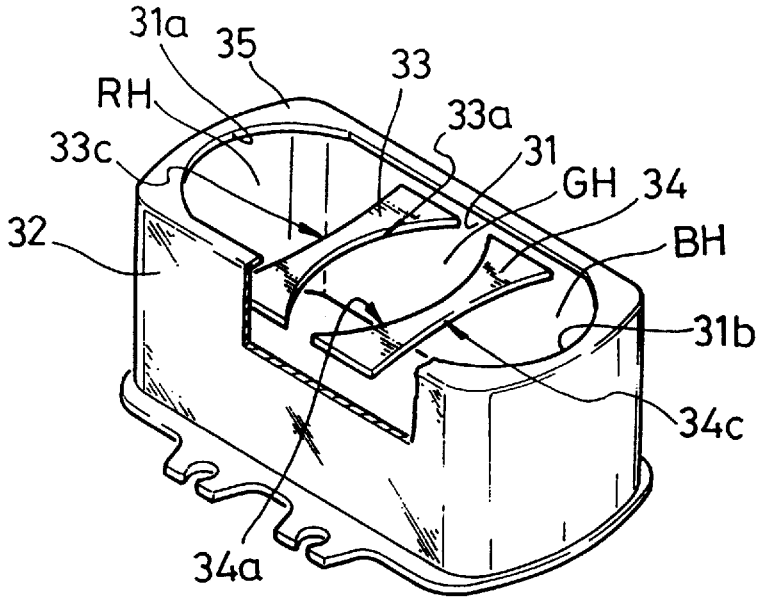
FIG. 6 is a partially cut away perspective view illustrating one electrode for electron guns of a color cathode ray tube shown in FIG. 5.
Figure 7:
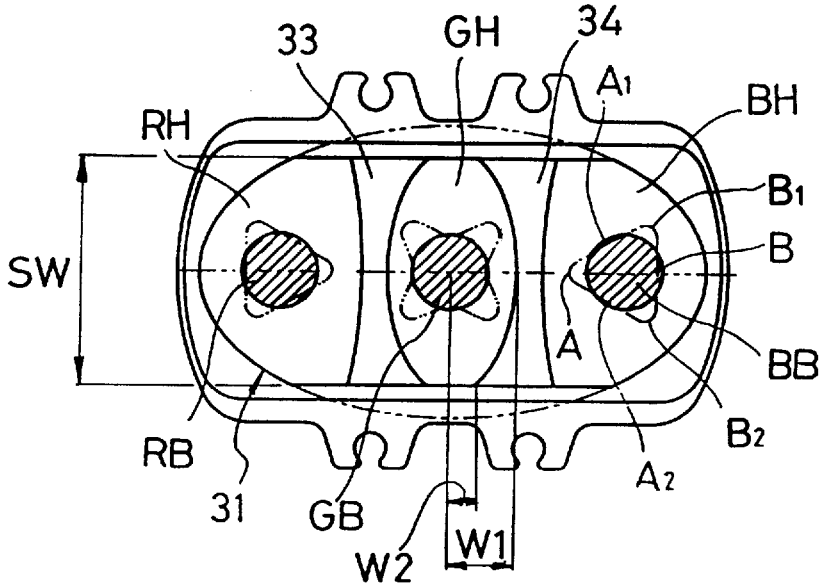
FIG. 7 is a front view illustrating the electrode shown in FIG. 6.

The structures of the converging electrode 30 and the final accelerating electrode 30' constituting the main lens are shown in FIGS. 6 and 7. Referring to FIGS. 6 and 7, the converging and final accelerating electrodes 30 and 30' each comprise an external rim electrode 32 in the center of which a large diameter electron beam-passing hole (hereinafter referred to as large aperture) 31 is located, and first and second internal electrode pieces 33 and 34 spaced from the top edge of the external rim electrode 32 and spaced apart from each other so as to form three in-line small diameter electron beam-passing holes (hereinafter referred to as small apertures) RH, GH and BH within the large aperture 31.

The shape of the large aperture 31 is defined by a flange 35 inwardly extending from the top edge of the external rim electrode 32.

The first and second internal electrode pieces 33 and 34 have a shape in which the width thereof becomes smaller from the ends to the center and the respective two edges 33*a* and 33*c*, and 34*a* and 34*c* thereof have predetermined curvatures. The internal edges 33*a* and 34*a* of the first and second internal electrode pieces 33 and 34 which, along with the flange, define the central small aperture GH are segments of an imaginary ellipse whose long axis is longer than the shorter width SW of the large aperture 31 as shown in FIG. 7.

The curvature of the internal edges 33*a* and 34*a* are appropriately set depending on the degree of aberration of the large diameter lens, and the internal edges 33*a* and 34*a* may have two curvature values according to circumstances. That is, in order to compensate for the difference in converging or diverging force due to the electric field acting in a direction of the major axis of the large aperture 31, the curvature of portions of the internal edges 33*a* and 34*a* facing each other can be different from that of the other portions.

In addition, curved edges 31*a* and 31*b* of the flange 35 defining the large aperture 31 and outer edges 33*c* and 34*c* of the first and second electrode pieces 33 and 34 are formed to offset the distortion of beam sections caused by coma-aberration, and it is preferable that the curved edges 31*a* and 31*b* are segments of an imaginary ellipse whose short axis is longer than the shorter width SW, as shown in FIG. 7.

In the operation of the electron gun electrode configured as above according to the present invention, to form an electron lens, predetermined voltages are applied to the respective electrodes shown in FIG. 5.

Then, equipotential surfaces are created in directions normal to lines of electric force between the electrodes to form the electron lens, and the electron beams pass through the electron lens. Since the large aperture 31 is non-circular or oblong as described above, vertical and horizontal converging components of the electron beam-passing through the central small aperture and the electron beams passing through the side small apertures are different from each other, as electron beams are subject to different converging and diverging forces. As the horizontal and diagonal distances from the central beam-passing through the large aperture 31 to the flange 35, over which low and high voltages are distributed, are relatively greater, the electron beam is subject to greater diverging forces in horizontal and diagonal directions. However, since the inner edges 33*a* and 34*a* of the first and second internal electrode pieces 33 and 34 are segments of an imaginary ellipse extending beyond the large aperture, the short axis width (2 □W1) of the central small aperture GH defined by the inner edges 33*a* and 34*a*, along with segments of the large aperture, is greater than the length of the segments. Accordingly, the electron beam GB passing through the central small aperture GH is subject to diverging forces in a vertical direction and converging forces in horizontal and diagonal directions, and therefore the cross section of the electron beam GB can be formed to be nearly circular. That is, the distortion of the electron beam can be corrected by the quadrupole and eight-pole converging/diverging forces.

Meanwhile, since the distances between the side electron beams RB and BB passing through the large aperture 31 and the flange 35 are different from each other depending on directions, the cross sections of the electron beams RB and BB form nearly triangular shape due to the difference between converging and diverging forces.

With the present invention, the dimensions of the electron beam-passing holes RH, GH and BH can be desirably adjusted by changing the curvature of the edges 33*a* and 33*c*, and 34*a* and 34*c* of the first and second electrode pieces 33 and 34.

Since the two curved edges 31*a* and 31*b* of the flange 35 and the outer edges 33*c* and 34*c* of the first and second internal electrode pieces 33 and 34, which define the small apertures RH and BH, each have elliptical curvatures, the cross-sectional shape of the side electron beams RB and BB can be adjusted. That is, in the cross sections of the electron beam BB, distorted portions A, A1 and A2 are corrected by varying the curvature of the outer edge 34*c* of the second internal electrode piece 34 and distorted portions B, B1 and B2 are corrected by varying the elliptical curvature of the edge 31*b* of the flange 35, and therefore the cross sections of the side electron beams RB and BB can become nearly circular. Accordingly, the beams RB, GB and BB having passed the electron lens all have a nearly circular cross section, and when they land at a point on the phosphor screen, the cross-sectional shapes of the beams at the screen are the same no matter where they land.

Figure 8:
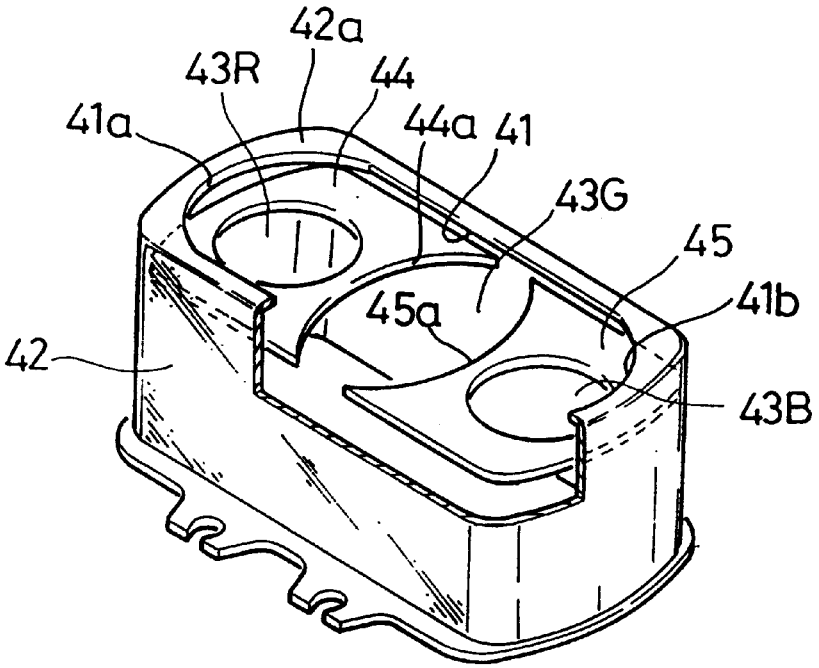
FIG. 8 is a partially cut away perspective view illustrating an electrode for electron guns according to another embodiment of the present invention.

FIG. 8 shows an electrode constituting a main lens according to another embodiment of the present invention.

As shown in FIG. 8, the electrode comprises an external rim electrode 42 in which a large aperture 41 is formed, and first and second internal electrode pieces 44 and 45 which are spaced apart from each other and contact the inner surface of the external rim electrode 42.

A central electron beam-passing hole 43G is formed between the first and second internal electrode pieces 44 and 45, and electron beam-passing holes 43B and 43R are located in the first and second internal electrode pieces 44 and 45, respectively. The inner edges 44*a* and 45*a* of the first and second internal electrode pieces 44 and 45 to have a predetermined curvature in order to form the central small aperture 43G therebetween. Edges other than the inner edges 44*a* and 45*a* of the first and second internal electrode pieces 44 and 45 contact the inner surface of the external rim electrode 42.

Figure 9:
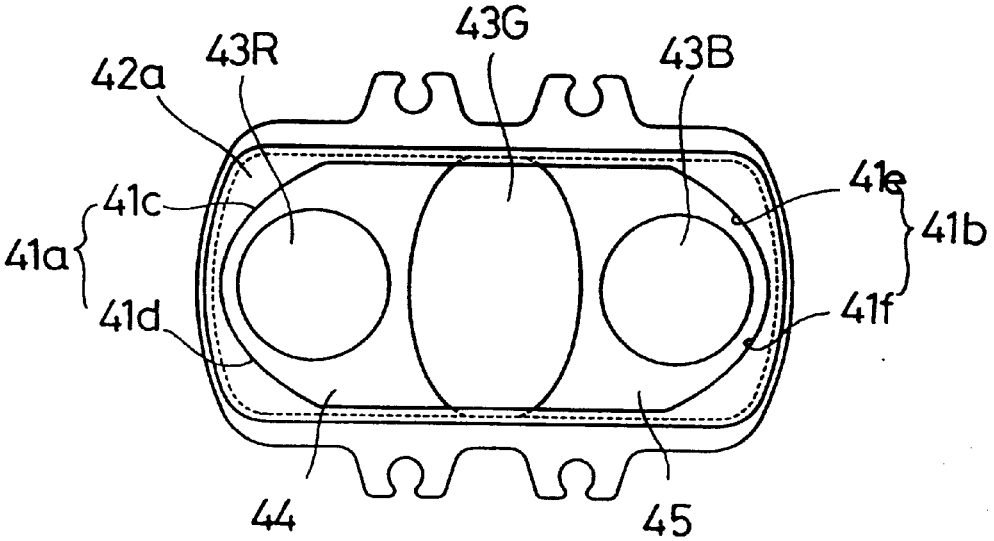
FIG. 9 is a front view illustrating the electrode shown in FIG. 8.

It is preferable that the small apertures 43B and 43R be circular. The large aperture 41 is defined by a flange 42*a* inwardly extending from the top edge of the external rim electrode 42, and it is preferable that curved edges 41*a* and 41*b* of the flange 42*a* have an elliptical curvature as shown in FIG. 9.

In addition, the curved edges 41*a* and 41*b* may be formed so that side edge portions 41*c* and 41*d*, and 41*e* and 41*f*, each having a predetermined curvature, can generally make a predetermined angle with respect to the central horizontal line of the large aperture 41.

The curvature of the curved edges 41*a* and 41*b* is appropriately set depending on the degree of distortion of the electron beams passing through the side electron beam-passing holes 43R and 43B.

Figure 10:
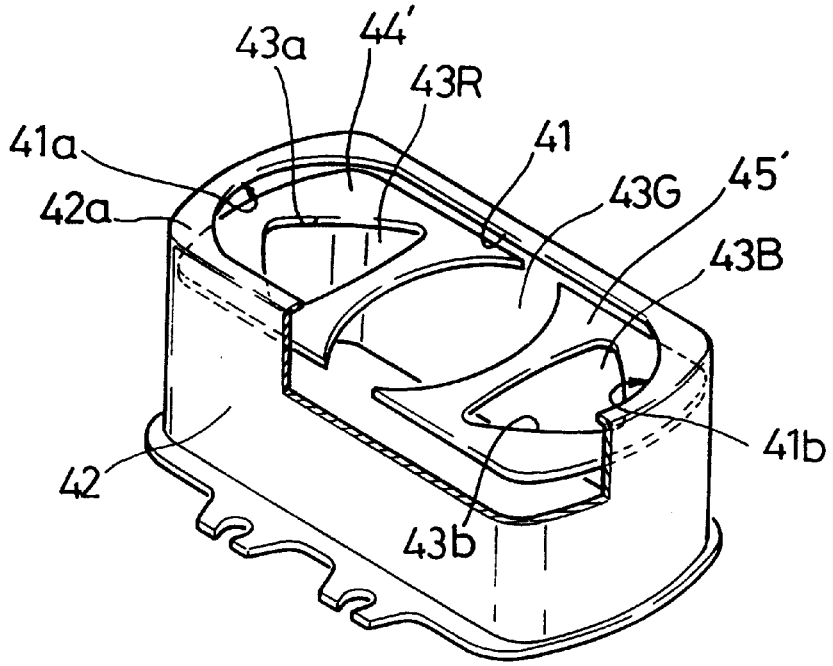
FIG. 10 is a partially cut away perspective view illustrating an electrode for electron guns according to still another embodiment of the present invention.
Figure 11:
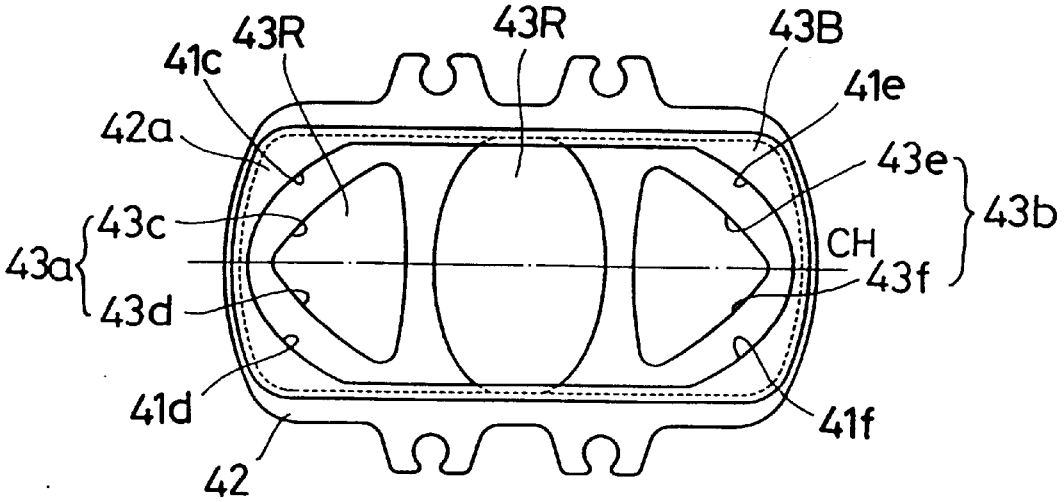
FIG. 11 is a front view illustrating the electrode shown in FIG. 10.

More embodiments of the present invention are shown in FIGS. 10 and 11. Here, the same reference numerals denote the same members of FIGS. 8 and 9. As shown in FIGS. 10 and 11, non-circular small apertures 43R and 43B are formed in first and second internal electrode pieces 44' and 45' of these embodiments.

In this case, it is preferable that, as shown in FIG. 11. each pair of hole edges 43*c* and 43*d* and 43*e* and 43*f* of the first and second internal electrode pieces 44' and 45' are symmetrical and to make an acute angle with respect the central horizontal line CH.

The same effect as described in the previous embodiment can be obtained by the electrodes shown in FIGS. 8 and 10.

With the electrode of electron guns for a color cathode ray tube according to the present invention, there are advantages in which the aberration of electron beams caused by a large aperture can be reduced, and the shapes of the electron beam sections can be changed as desired.

Although particular embodiments of the invention have been described with reference to the accompanying drawings for the purposes of illustration, it should be understood that various modifications and equivalents may be made by those skilled in the art without departing from the spirit and scope of the invention. Accordingly, it must be understood that the invention is limited only by the attached claims.

What is claimed is:

1. An electrode for electron guns of a color cathode ray tube including:

an external rim electrode having a large electron beam-passing hole through which three electron beams pass; and first and second internal electrode pieces mounted in the external rim electrode, separated from each other and forming a central small electron beam-passing hole and two side small electron beam-passing holes on opposite side of the central small electron beam-passing hole, the central small electron beam-passing hole being defined by inner edges of the first and second internal electrode pieces, facing each other, wherein the inner edges describe parts of an ellipse.

2. The electrode as claimed in claim 1, wherein the external rim electrode further includes an inwardly extending flange having an edge defining the large electron beam-passing hole.

3. The electrode as claimed in claim 2, wherein each of the two side small electron beam-passing holes is defined by respective outer edges of the first and second internal electrode pieces and a part of the edge of the flange.

4. The electrode as claimed in claim 3, wherein the outer edges have a curvature.

5. The electrode as claimed in claim 2, wherein edges, other than the inner edges, of the first and second internal electrode pieces contact the external rim electrode, and the two side small electron beam-passing holes are located in the first and second internal electrode pieces, respectively.

6. The electrode as claimed in claim 5, wherein the two side small electron beam-passing holes are circular.

7. The electrode as claimed in claim 5, wherein the two small side electron beam-passing holes are not circular.

8. The electrode as claimed in claim 7, wherein edges of the two side electron beam-passing holes are symmetrical and have portions making acute angles with respect to a line passing through a center of the large electron beam-passing hole.

* * * * *